US006782223B2

(12) United States Patent
Yoshida

(10) Patent No.: US 6,782,223 B2
(45) Date of Patent: Aug. 24, 2004

(54) PHOTOCOPIER AND MULTIFUNCTIONAL PRINTER HAVING AN OPENING AND CLOSING COVER

(75) Inventor: Yasutoshi Yoshida, Tokyo (JP)

(73) Assignee: Panasonic Communication Co., Ltd., Fukuoka (JP)

( * ) Notice: Subject to any disclaimer, the term of this patent is extended or adjusted under 35 U.S.C. 154(b) by 0 days.

(21) Appl. No.: 10/327,077

(22) Filed: Dec. 24, 2002

(65) Prior Publication Data

US 2003/0170047 A1 Sep. 11, 2003

(30) Foreign Application Priority Data

Mar. 6, 2002 (JP) ..... 2002-060947

(51) Int. Cl.[7] ..... G03G 15/00
(52) U.S. Cl. ..... 399/124; 399/107; 399/110
(58) Field of Search ..... 399/107, 110, 399/124; 312/290, 322, 323, 327, 328

(56) References Cited

U.S. PATENT DOCUMENTS 6,501,485 B1 * 12/2002 Dash et al.

FOREIGN PATENT DOCUMENTS

JP 04360161 A * 12/1992 ..... G03G/15/00
JP 11024353 A * 1/1999 ..... G03G/15/00

* cited by examiner

*Primary Examiner*—Arthur T. Grimley
*Assistant Examiner*—Ryan Gleitz
(74) *Attorney, Agent, or Firm*—Greenblum & Bernstein, P.L.C.

(57) ABSTRACT

A photocopier includes an intermediate member that is provided pivotably to the photocopier through a freely pivoting joint and an opening and closing cover that is provided pivotably to the intermediate member through a freely pivoting joint. The intermediate member is connected to the photocopier at one edge of the intermediate member. Further, the opening and closing cover is connected to the intermediate member at other edge opposite to the edge of the intermediate member. When the opening and closing cover is opened, image recording system located within the photocopier is exposed.

12 Claims, 17 Drawing Sheets

Prior Art

PHOTOCOPIER AND MULTIFUNCTIONAL PRINTER HAVING AN OPENING AND CLOSING COVER

BACKGROUND OF THE INVENTION

1. Field of the Invention

The invention relates to a photocopier or multifunction printer equipped with a hinged opening and closing cover able to provide access to clear paper jams or perform maintenance operations within the image registration area.

2. Description of Related Art

FIG. 15 illustrates a conventional photocopier or multifunction printer (hereafter referred to as the "photocopier") to which opening and closing cover 1501 is installed to the front side thereon in the form of a pivoting structure able to expose the internal area of the photocopier. As shown in FIG. 15, a hinge installed at the bottom edge of opening and closing cover 1501 provides pivoting support that allows the top of the panel to swing out and away from the photocopier when opened.

A toner bottle is exposed when opening and closing cover 1501 is opened, the purpose of the toner bottle being to supply toner to the developer unit which comprises part of the image registration system. The toner bottle is pivotably installed to be able to swing out away from the photocopier. The pivoting direction of the toner bottle is determined by the location of the hinge pin, installed either on the left or right side, that allows the opposite end of the toner bottle to swing out away from the photocopier. The developing unit and other components of the image registration system are located behind the toner bottle.

To perform maintenance work on the image registration system, opening and closing cover 1501 must first be opened, the toner bottle pivoted outward, and the developer unit and other mechanisms located in the internal area of the photocopier pulled out.

The above-described structures, however, exhibit certain shortcomings which are explained below.

As photocopiers become more functionally advanced, an automatic document re-feeder, which is required for dual-side printing, has been conventionally offered as optional equipment, although an increasing number of photocopiers now include this function as a standard built-in feature. As a result, the size of photocopiers incorporating a built-in document re-feeder have larger external dimensions. There is a market, however, for photocopiers that incorporate an automatic document re-feeder that does not increase the external dimensions of the photocopier. In order to produce this type of photocopier, it becomes necessary to reduce the size of the components within the photocopier as well as the space between those components.

In light of these factors, it has become essential to reduce the space required for the hinge on which opening and closing cover 1501 pivots, a space which has been conventionally been provided between the image registration system and the paper cassette drawers. The conventional installation of the hinge in the space between the image registration system and paper cassette drawers has the adverse effect of increasing the overall size of the photocopier. As a result, the hinge is not installed in that location within the photocopier where various mechanisms overlap in close proximity, but at the extreme left or right hand side of the copier, as shown in FIG. 16, to allow opening and closing cover 1501 to pivot to the left or right when opened.

Structuring the copier to allow opening and closing cover 1501 to pivot open to the left or right, however, results in various shortcomings that are explained below.

The structure whereby opening and closing cover 1501 swings open to the left or right creates a problem in that it restricts the angle to which opening and closing cover 1501 can be opened. This problem becomes apparent, as shown in FIG. 17, in cases where hinge 1701 is installed internally to the photocopier.

In this case, as shown in FIG. 17, opening and closing cover 1501 cannot open beyond a point at which its front surface comes into contact with the photocopier frame. Moreover, opening and closing cover 1501 must be opened and toner bottle 1702 swung out of the way before maintenance can be performed on the image registration system.

The restricted angle to which opening and closing cover 1501 opens also has the effect of restricting the angle to which toner bottle 1702 can swing out. The result is that toner bottle 1702 is not able to swing out to an angle sufficient to allow developer unit 1703 and other mechanisms installed behind toner bottle 1702 to be pulled out for maintenance.

To compensate for the limited opening angle of toner bottle 1702, developer unit 1703 and other internal components must be located a sufficient distance away from the pivoting hinge of toner bottle 1702 to allow their unobstructed withdrawal from the photocopier as shown in FIG. 18. For reasons of image quality, however, developer unit 1703 and other components which comprise the image registration system must be placed in an arrangement that provides for specific separation distances between the components. Placing these mechanisms a sufficient distance from the hinge of toner bottle 1702, however, has the adverse effect of significantly increasing in the width of the photocopier.

As shown in FIG. 19, hinge 1801 of opening and closing cover 1501 can be installed on the external surface of the photocopier in order to allow opening and closing cover 1501 to open widely without the front surface of the opening and closing cover contacting the photocopier frame. Mounting hinge 1801 externally, however, increases the external dimensions of the photocopier an amount equivalent to the protrusion of hinge 1801.

SUMMARY OF THE INVENTION

In order to eliminate the aforesaid problems, the present invention puts forth a structure for a photocopier that incorporates a left or right pivoting opening and closing cover that is able to open to a sufficiently wide angle to permit convenient access to internal components for maintenance purposes, and that does not increase the external dimensions of the photocopier.

The present invention is comprised of a left or right pivoting opening and closing cover installed to the front of a photocopier, and a pivoting intermediate member, of which a right or left edge thereof is pivotably joined to an internal side of an external surface of the photocopier, and of which the edge opposite to the aforesaid right or left edge provides pivoting support for the opening and closing cover.

The provision of the pivoting intermediate member between the pivoting access cover and photocopier frame allows the opening angle of the pivoting intermediate member to be added to the opening angle of the opening and closing cover, thus permitting the opening and closing cover to open to a wide angle sufficient to allow convenient access to the internal portion of the photocopier for maintenance work.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

The following describes an embodiment of the present invention in reference to the above-mentioned drawings.

Figure 1:
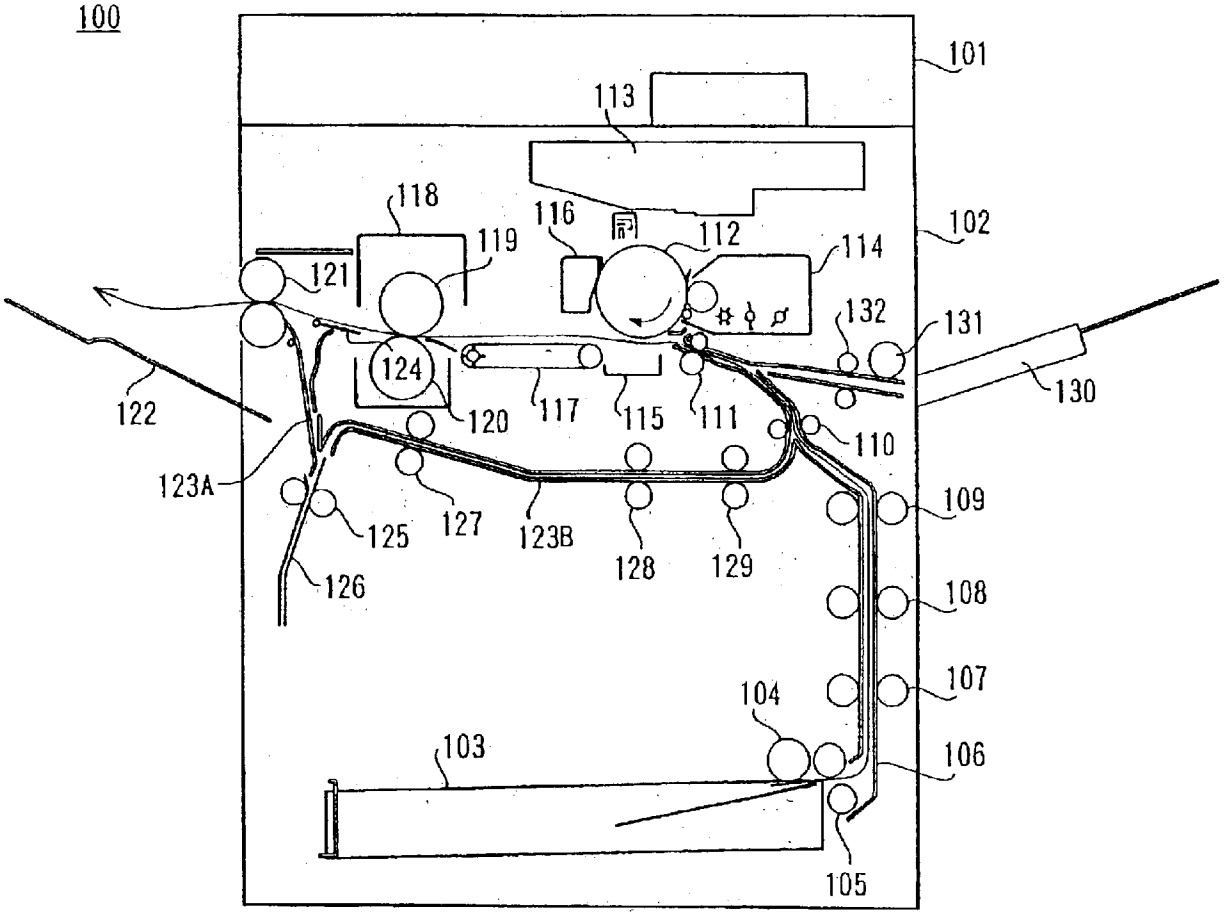
FIG. 1 is an outline drawing of the internal structure of a photocopier as embodied by the invention, FIG. 2(*a*) is a front view of the photocopier embodiment and FIG. 2(*b*) is a side view of the photocopier embodiment.

FIG. 1 is an outline drawing of the present invention embodied as photocopier 100.

As illustrated in FIG. 1, readout unit 101 is installed at the top portion of photocopier 100 in order to read the document to be copied, and main unit 102, which executes paper supply, image transfer, image registration, and fixing functions, is located beneath readout unit 101.

Paper supply cassette 103 is installed within the lower portion of main unit 102. The top sheet of paper held in paper supply cassette 103 is removed from the stack by pickup roller 104.

The sheet removed from the stack in paper supply cassette 103 is transported upward from the lower portion of main unit 102 through paper path 106 which is defined by the placement of multiple transport rollers 105, 107, 108, and 109.

After passing topmost transport rollers 109, the sheet of paper is fed by transport rollers 110 to registration rollers 111 which bring the sheet of paper up to photosensitive drum 112 that rotates in the direction shown by the curved arrow in FIG. 1.

Laser scanning unit 113, which is positioned above photosensitive drum 112, forms a latent image on the surface of photosensitive drum 112. Toner is then applied to the latent image formed on photosensitive drum 112 by proximally located developer unit 114. An agitation-transport roller and toner developer roller, the latter being used to apply toner to photosensitive drum 112, are installed within developer unit 114.

Image transfer unit 115, which is installed beneath photosensitive drum 112, has the purpose of transferring toner, which adheres to photosensitive drum 112, to the supplied sheet of paper. Registration rollers 111 control the position of the image registration region on the sheet of paper in relation to photosensitive drum 112.

Cleaning unit 116 is installed in proximity to photosensitive drum 112 in order to clean the surface of photosensitive drum 112 after the image has been transferred to the sheet of paper. The sheet of paper to which the image has been transferred is then carried to fixing unit 118 by transport belt 117.

Fixing unit 118 consists primarily of fixing roller 119, pressure roller 120 installed opposite to fixing roller 119, and an oil-covered cleaning roller (not illustrated in the figure) that improves the efficiency with which residual toner can be removed from fixing roller 119. Fixing roller 119 heats the image registration surface of the sheet of paper while pressure roller 120 presses the sheet of paper against fixing roller 119 in order to fix the image securely to the sheet of paper.

The sheet of paper, after being discharged from fixing unit 118, is transported out of main unit 102 into delivery tray 122.

While the sheet of paper is normally ejected to the area external to main unit 102, re-feed switching guide 124 is provided between fixing unit 118 and discharge rollers 121 as means of diverting the direction of the exiting sheet of paper toward re-feed path 123 which extends downward from the proximity of switching guide 124 and continues in an approximately horizontal direction.

The sheet of paper, once directed toward re-feed path 123, is transported by reversing rollers 125 into turnover path 126 which extends downward from portion 123A of the re-feed path. Once the sheet of paper enters turnover path 126, reversing rollers 125 rotate in the opposite direction to transport the sheet of paper into approximately horizontal portion 123B of re-feed path 123. At this point the directional orientation of the two surfaces of the sheet of paper have been reversed.

After entering approximately horizontal section 123B of the re-feed path, the sheet of paper is transported through section 123B by transport rollers 127, 128, and 129 and into paper path 106 as a result of section 123B merging with paper path 106 at a point below transport rollers 110. The sheet of paper is then again transported through paper path 106 to the area beneath photosensitive drum 112 which transfers an image to the side of the paper opposite to that on which the original image was formed.

Manual feed tray 130 is installed on the side of main unit 130 in order to allow paper other than that held in paper feed cassette 103 to be fed into the photocopier. The top sheet of paper of the stack on manual feed tray 130 is fed into the photocopier by pickup roller 131, and then fed to registration rollers 111 by transport rollers 132.

This type of structure for photocopier 100 incorporates an opening and closing cover on the front of the photocopier to provide access to the internal area in order to clear paper jams or perform maintenance on the image registration system.

Figure 2:
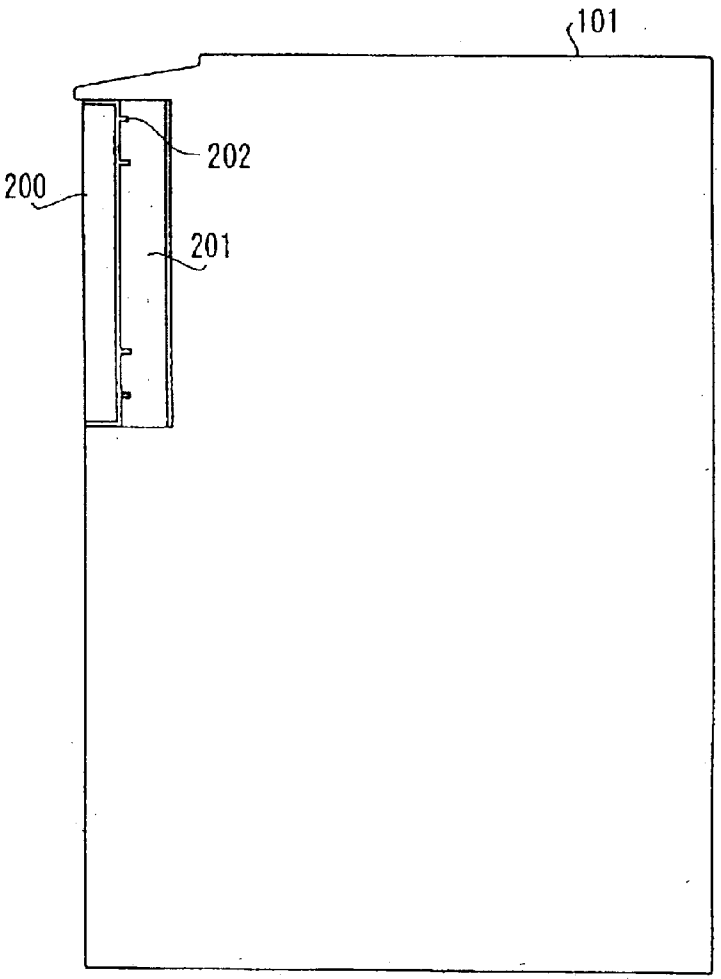
Figure 2:
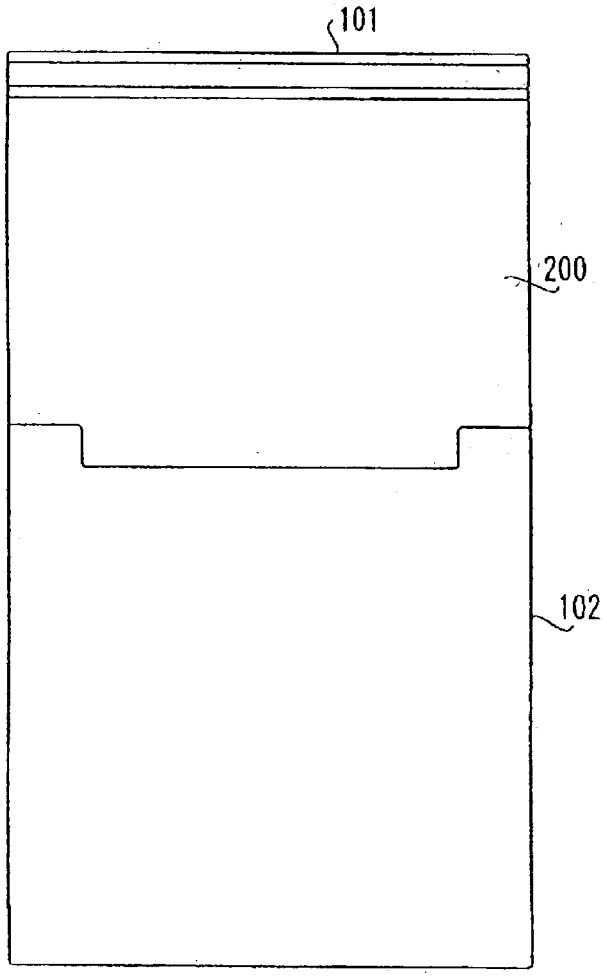

FIG. 2 is a line drawing providing front and side views of the photocopier as embodied by the invention. View (a) is from the front, and view (b) is from the side of photocopier 100. View (b) illustrates the front opening and closing cover in a closed condition. Manual feed tray 130 has been omitted from these drawings.

FIG. 2*a* shows that opening and closing cover 200 is located on the front of photocopier 100 at the upper region thereon. When closed, opening and closing cover 200 becomes one of the panels that defines the front surface of photocopier 100.

Opening and closing cover 200 is attached to photocopier 200 through a pivoting intermediate member hereafter referred to as pivot plate 201. Moreover, in this embodiment, pivot plate 201 is connected to the right edge of opening and closing cover 200. As shown in FIG. 2*b*, when photocopier 100 is viewed from the side, pivot plate 201 appears as one of the panels that defines the side of photocopier 100.

The end of opening and closing cover 200 opposite to the end supported by pivot plate 201 swings open in an outward direction from the front of photocopier 100. When opening and closing cover 200 is opened, its movement is restricted by the cover coming into contact with pivot plate 201 which is attached thereto. To eliminate this restriction, notches 202 are provided at specific locations on pivot plate 201.

Figure 3:
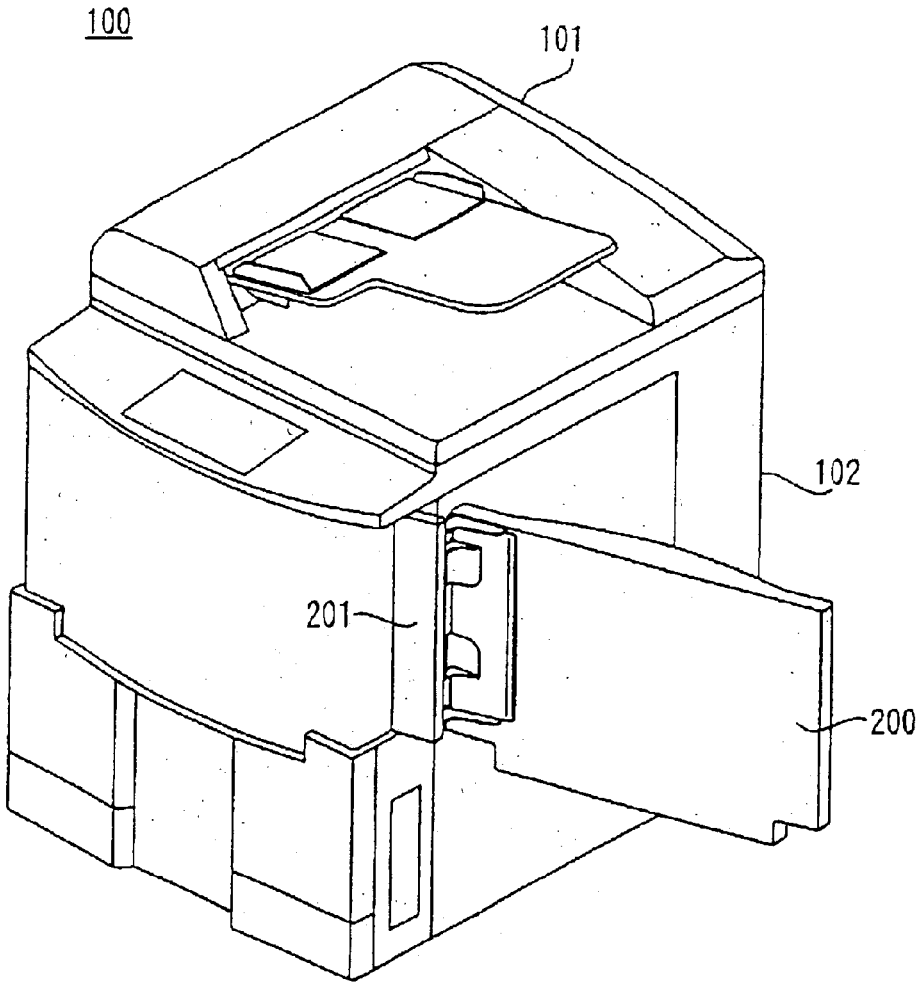
FIG. 3 is an external perspective view of the photocopier embodiment.

FIG. 3 provides a perspective view of the photocopier 100 embodiment in which opening and closing cover 200 is open to the widest possible angle.

As shown in the figure, the right edge of opening and closing cover 200 is attached to photocopier 100 through pivot plate 201, thus allowing the left edge of the opening and closing cover to swing outward to expose the internal area of photocopier 100.

Opening access cover 200 will expose the toner bottle (to be described subsequently) behind which are located photosensitive drum 112, laser scanning unit 113, developer unit 114, transfer unit 115, and cleaning unit 116, all of which comprise the image registration system.

As illustrated in FIG. 3, under a certain condition pivot plate 201 is able to pivot together with access cover 200 as if the two components were a single rigid structure. To be more specific, when opening and closing cover 200 swings open to the maximum extent allowed by the hinged connection with pivot plate 201, pivot plate 201 will then itself pivot as if it were a fixed part of opening and closing cover 200, thus forming a hinge mechanism that allows opening and closing cover 200 to open to the extent where it forms an approximate 90° angle relative to the side of photocopier 100 as shown in FIG. 3.

Figure 4:
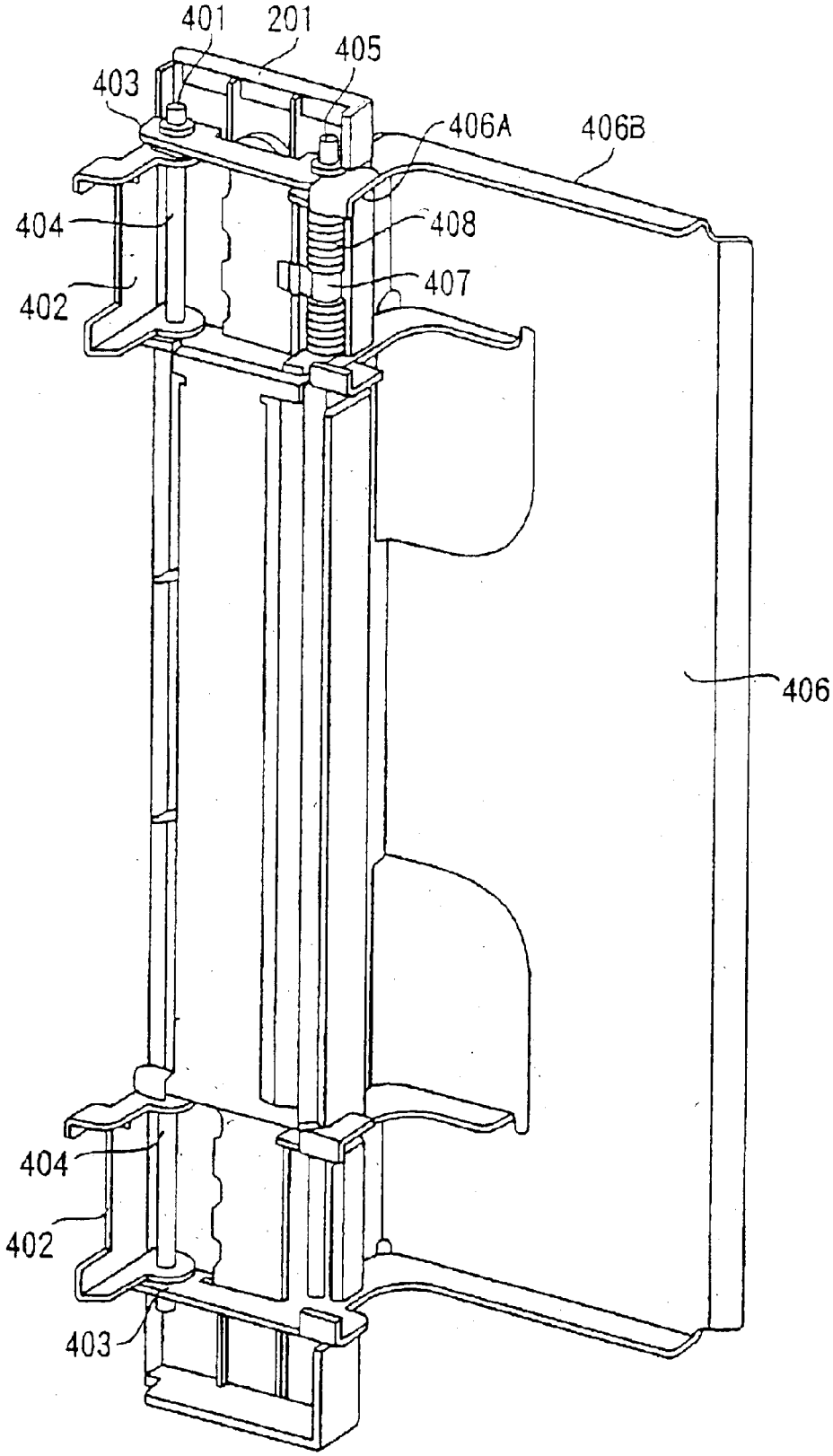
FIG. 4 is an enlarged perspective view of the pivoting intermediate member (pivot plate), FIGS. 5(*a*) and 5(*b*) are top views of the photocopier embodiment, FIGS. 6(*a*) and 6(*b*) are top views of the photocopier embodiment, FIGS. 7(*a*) and 7(*b*) are top views of the photocopier embodiment, FIGS. 8(*a*) and 8(*b*) are top views of the photocopier embodiment.

FIG. 4 provides an enlarged perspective view of pivot plate 201 as it is used on photocopier 100. The orientation of pivot plate 201 to photocopier 100 shown in FIG. 4 is the same as that shown in FIG. 3. That is, pivot plate 201 is in approximate planar alignment with opening and closing cover 200 which has been opened approximately 90° relative to the side of photocopier 100. FIG. 4 does not show opening and closing cover 200, but illustrates L-bracket 406 through which opening and closing cover is pivotably connected to pivot plate 201.

As shown in FIG. 4, first hinge 401 is installed to the left edge of pivot plate 201 and is used to connect pivot plate 201 to photocopier 100. When pivot plate 201 is closed against photocopier 100, first hinge 401 is located further within the internal region of photocopier 100 than pivot plate 2011.

First hinge 401 is comprised of stationary hinge bracket 402 which is attached to photocopier 100, and pivoting hinge bracket 403 which is formed on pivot plate 201. Stationary hinge bracket 402 and pivoting hinge bracket 403 are joined through hinge pin 404.

As is further illustrated in FIG. 4, pivot plate 201 is attached to L-bracket 406, which is fixedly secured to opening and closing cover 200, through second hinge pin 405.

Second hinge 405 is formed from the structure in which short side 406A of L-bracket 406 (L-bracket 406 being fixedly attached to pivot plate 201) pivotably connects to hinge plate 403 through hinge pin 407. Second hinge 405 is able to pivot to an extent that allows opening and closing cover 200 to assume an approximate 90° angle in relation to pivot plate 201.

Opening and closing cover 200 overlaps the right side of the flat surface provided by long side 406B of L-bracket 406, and is fixedly secured to that flat surface. As a result, long side 406B and access cover 200 always face the same direction.

Spring 408 is installed around second hinge 405 and applies pressure in a direction that prevents the rotation of pivot plate 201 when opening and closing cover 200 is not in a fully open position. In other words, when opening and closing cover 200 is open to an angle less than 90° relative to pivot plate 201, spring 408 applies pressure in a direction that prevents pivot plate 201 from pivoting open.

At the point where access cover 200 extends to a fully open position, the pressure applied by spring 408 holds pivot plate 201 and opening and closing cover 200 in mutually fixed positions, thereby allowing the two components to continue to pivot open as a single rigid structure. In other words, when opening and closing cover 200 is opened to an angle greater than approximately 90° relative to pivot plate 201, spring 408 applies pressure in a way that holds pivot plate 201 and opening and closing cover 200 in mutually unchanging positions.

Accordingly, when opening and closing cover 200 is not fully open, for example, if opening and closing cover 200 is in a half-closed position, pivot plate 201 will always be closed. This mechanism thus prevents opening and closing cover 200 from pivoting at a point that would cause it to close in a position out of alignment with photocopier 100.

Moreover, the positional restriction of pivot plate 201 in relation to the opening angle of opening and closing cover 200 provides the following advantageous effects.

In cases where a paper jam must be cleared, opening and closing cover 200 can be swing open to an angle of approximately 90° to provide sufficient clearance for the photocopier operator to remove the piece of paper causing the jam. In this case it is not necessary to open opening and closing cover 200 to the extent where pivot plate 201 begins to pivot.

If opening and closing cover 200 is opened to an angle less than approximately 90°, pressure is applied to pivot plate 201 in a way that maintains the pivot plate in a closed position. As a result, once the operator clears the paper jam with opening and closing cover 200 opened only to an approximate 90° angle, the opening and closing cover remains in close proximity to the photocopier operator who can conveniently grasp the edge of the opening and closing cover and close it without the need to stand up and reach. This mechanism allows opening and closing cover 200 to be closed quickly and comfortably, thus making operation of the photocopier more convenient.

In cases where the internal area of the photocopier must be accessed for service or maintenance, opening and closing cover 200 is able to open to an angle greater than 90° to allow sufficient space to pull out developer unit 114 and other components located within photocopier 100. If the opening and closing cover pivots open to an angle greater than 90°, pivot plate 201 will move simultaneously with opening and closing cover 200 as if the two components were a single rigid structure, thus allowing access cover 200 to open to a considerably wider angle that allows access to the internal area of photocopier 100.

The following discussion describes the invention embodied as photocopier 100, specifically the operation of the hinge mechanism used to connect opening and closing cover 200 to photocopier 100. FIGS. 5 and 6 illustrate plan views of the photocopier 100 embodiment.

Figure 5A:
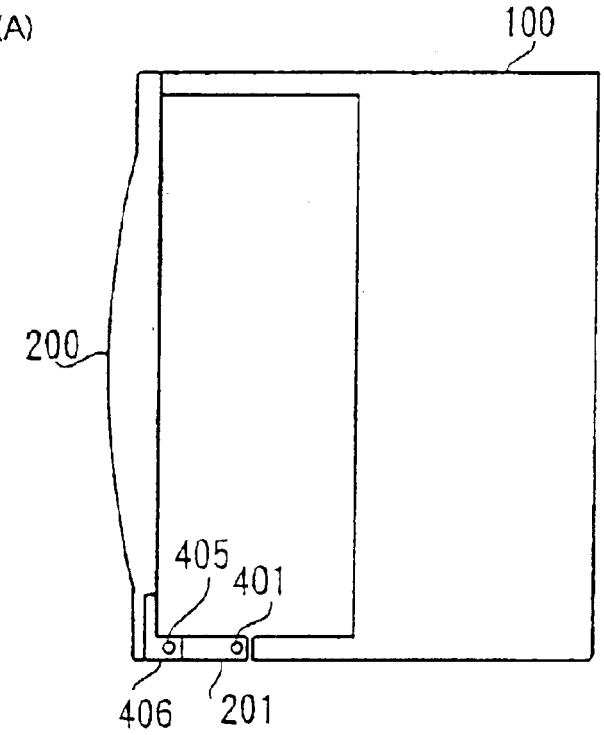

FIG. 5*a* illustrates opening and closing cover 200 in a closed position. It is obvious, of course, that opening and closing cover 200 is not in a fully opened position. Pivot plate 201 would not move even if opening and closing cover 200 were to be opened from this closed position.

If opening and closing cover 200 is swung open from the closed position as shown in FIG. 5*a*, the left edge of the cover swings outward (as shown in the upper portion of FIG. 5*b*) on second hinge 405 while pivot plate 201 maintains a fixed position as a result of the pressure applied by spring 408.

Figure 5B:
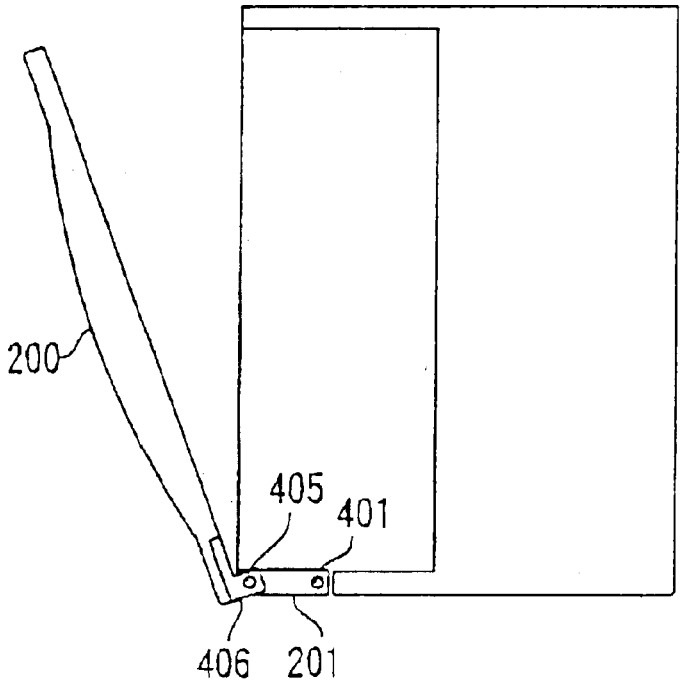
Figure 6A:
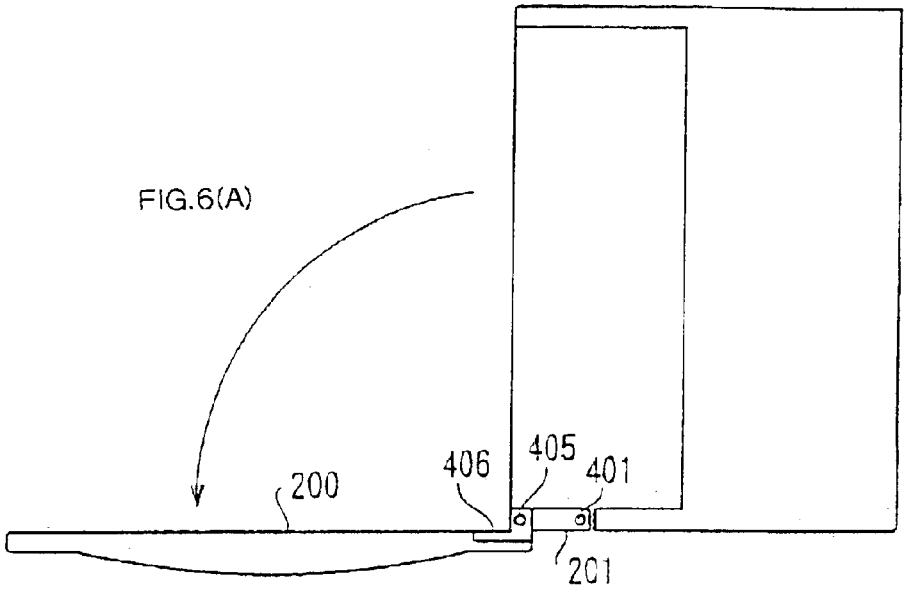

Opening and closing cover 200 continues to pivot open from the position shown in FIG. 5*b* to that shown in FIG. 6*a* where the opening and closing cover has rotated 90° relative to pivot plate 201. This is the point at which opening and closing cover 200 has fully opened and at which pressure applied by spring 408 will hold pivot plate 201 and opening and closing cover 200 in a mutually fixed relationship, thus allowing the pivot plate and opening and closing cover to rotate as a single structure.

Figure 6B:
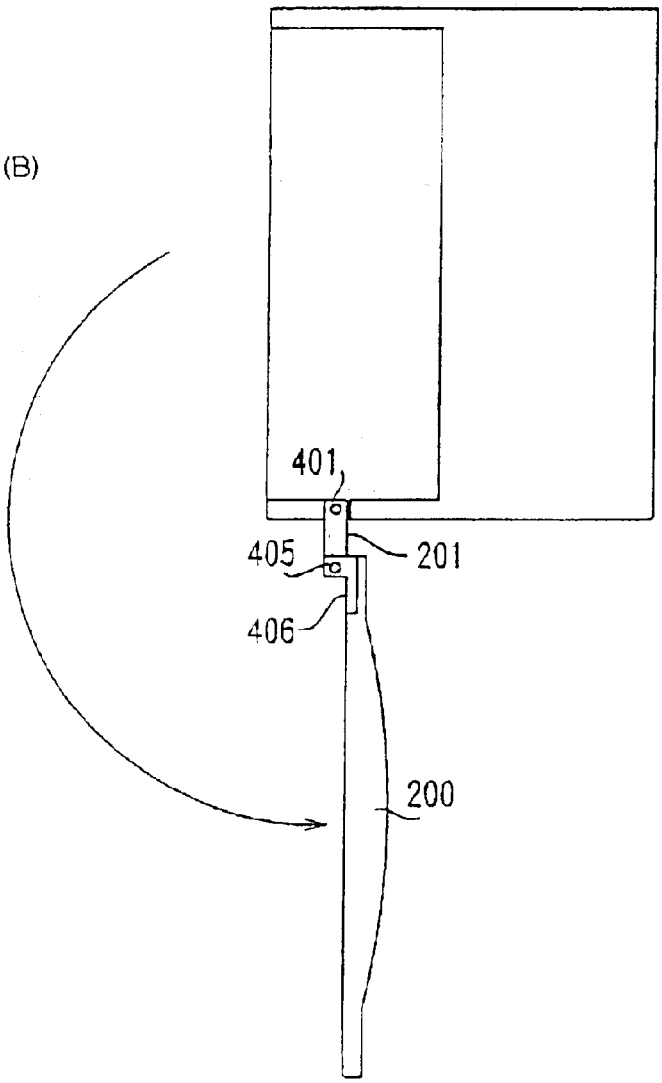

Opening and closing cover 200 continues to rotate open from the position shown in FIG. 6*a* to the position shown in FIG. 6*b* where pivot plate 201, pivotably supported by first hinge 401, has rotated outward from the side of photocopier 100. FIG. 6*b* shows that pivot plate 201 has rotated 90°, which is the maximum extent of rotation, in relation to the side of photocopier 100.

This embodiment of photocopier 100 describes a structure in which opening and closing cover 200 can swing open in a right or left hand direction through attachment to photocopier 100 through pivot plate 201. This mechanism allows opening and closing cover 200 to swing open away from main unit 102 to a rotational angle that equals the sum of the rotational angles of both opening and closing cover 200 and pivot plate 201. As a result, opening and closing cover 200 can be opened to an angle that allows sufficient access to the internal area of the photocopier for maintenance and service work.

Moreover, in this embodiment, first hinge 401 pivotably supports pivot plate 201 at a location inside of the external surface of photocopier 100. Compared to a structure in which the hinge is installed outside of the external surface of photocopier 100, first hinge 401 does not protrude into the area outside of the external surface of the photocopier, and thus does not increase the external dimensions of the photocopier.

In this embodiment, opening and closing cover 200 is installed to photocopier 100 through pivot plate 201. As a result of this type of hinge structure, opening and closing cover 200 is able to open to an angle that is greater, in relation to main unit 102, than would be allowed if opening and closing cover 200 were independently hinged, this greater opening angle being possible even though first hinge 401 is installed inside of the external surface main unit 102. Opening and closing cover 200 is thus able to swing open to a sufficiently wide angle.

Moreover, in this embodiment, opening and closing cover 200 is supported in a manner that allows it to swing open approximately 90° relative to pivot plate 201. Also, pivot plate 201 is pivotably supported in a manner that allows the pivot plate to swing open 90° relative to photocopier 100. As a result, the maximum opening angle of opening of pivot plate 201, which is installed to the inside of the external surface of photocopier 100, is combined with the maximum opening angle of opening of opening and closing cover 200, which is installed to the inside of the external surface of pivot plate 201, to allow a total opening angle of 180°. First hinge 401 and second hinge 405, although not installed at a location outside of the external surface of the photocopier, still allow access cover 200 to open to a sufficiently large angle without increasing the external dimensions of the photocopier.

Furthermore, in this embodiment, opening and closing cover 200, when closed, becomes an integral part of the front surface of photocopier 100, and pivot plate 201, when closed, becomes an integral part of the side surface of photocopier 100. As a result, even though the surface of opening and closing cover 200 comes into contact with the frame of photocopier 100 when the opening and closing cover is opened, the part of the frame that comes into contact with the opening and closing cover is able to pivot together with the opening and closing cover. Therefore, even though the hinges on which opening and closing cover 200 rotates are installed inside of the external surface of photocopier 100, the pivotal movement of the opening and closing cover is not restricted, thus allowing the opening and closing cover to swing open to a significantly wide angle.

In cases where maintenance work must be performed on the developer unit or other parts of the image registration system, opening and closing cover 200 is opened after which the toner bottle is swung outward. The following discussion describes the operation of photocopier 100 as it relates to obtaining access for the aforesaid maintenance work.

Figure 7A:
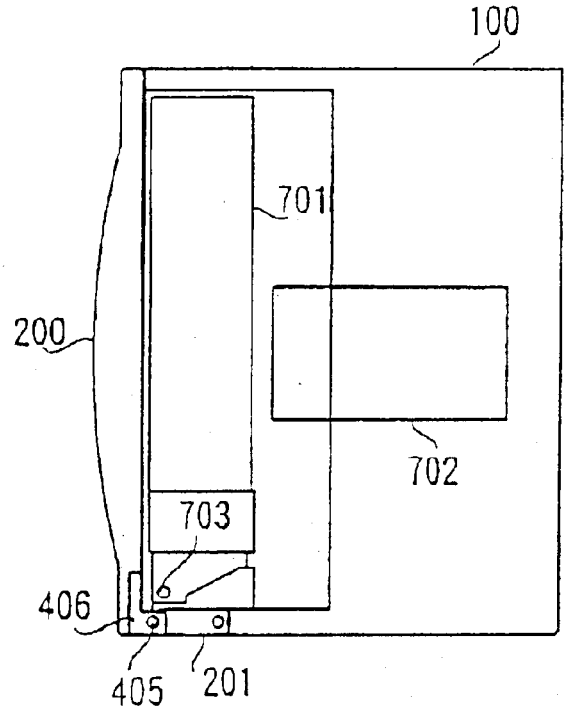

FIGS. 7 and 8 provide a plan view of the embodied photocopier 100.

As shown in FIGS. 7 and 8, toner bottle 701 is installed to the photocopier at a location that is exposed when opening and closing cover 200 is open. Image registration unit 702, which is located behind toner bottle 701, is comprised of developer unit 114 and other components. FIG. 7 illustrates a structure for photocopier 100 wherein image registration unit 702 is located in the central region of the photocopier.

Toner bottle 701 is pivotably supported by hinge pin 703 which is located at the bottom portion of the photocopier as viewed in the orientation shown in FIG. 7. Toner bottle 701 is thus able to swing downward and to the left, as viewed in FIG. 7, in a direction away from the internal area of the photocopier.

Figure 7B:
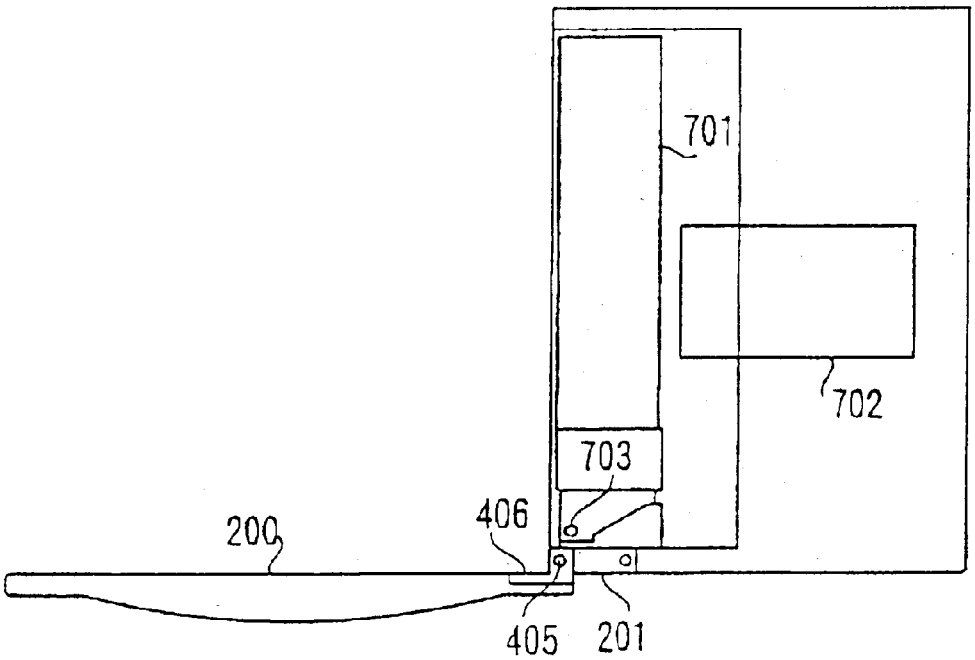

When maintenance work is to be performed on image registration unit 702, the service technician must first swing open opening and closing cover 200 from a closed position (FIG. 7*a*) to a position where the opening and closing cover has opened approximately 90° (FIG. 7*b*). It is at this position that, as previously described, pivot plate 201 begins to pivot in unison with opening and closing cover 200 as if the two components were a single structure.

Figures 8A, 8B:
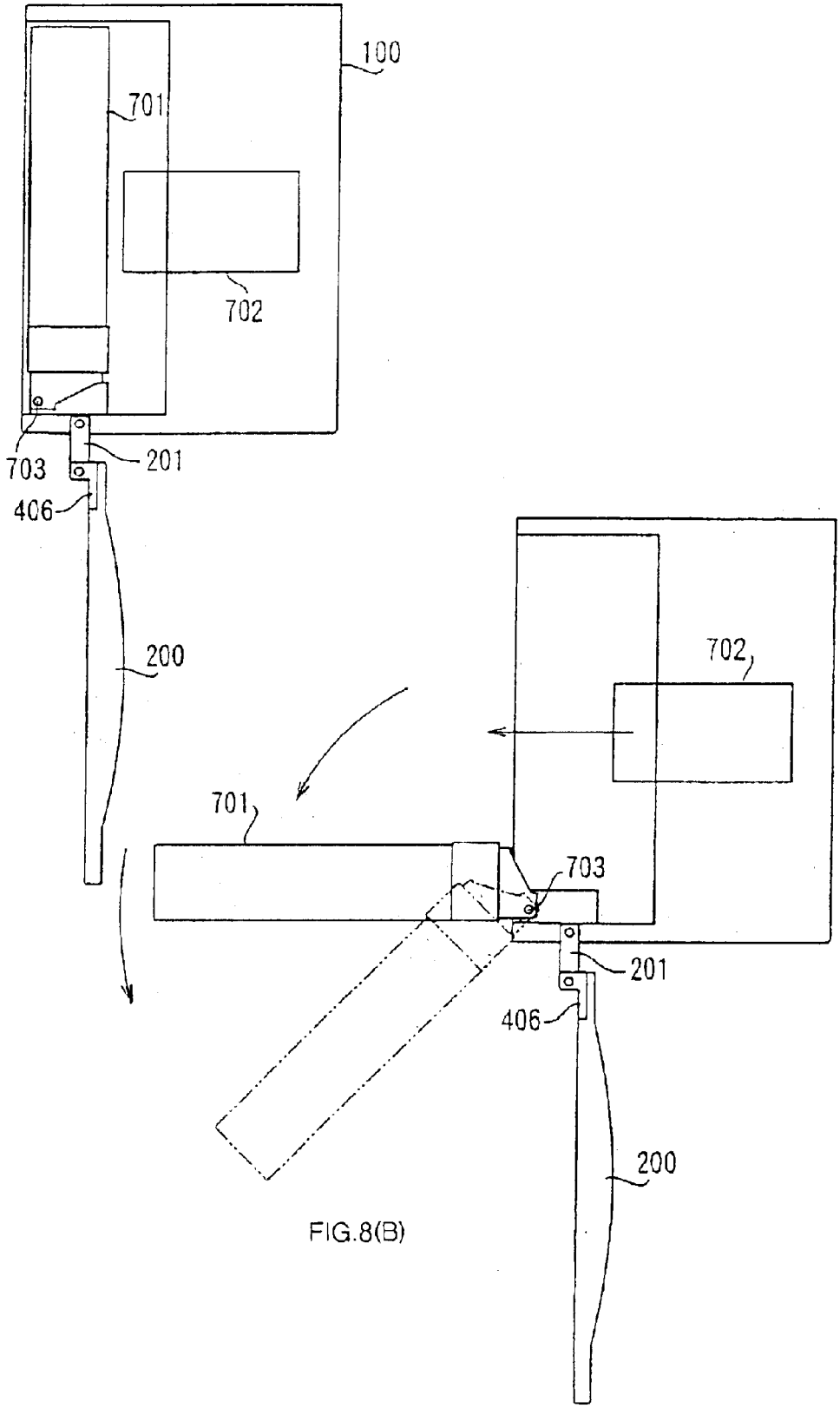

The continued opening of opening and closing cover 200 from the position shown in FIG. 7*b* to that shown in FIG. 8*a* will result in pivot plate 201 pivoting together with opening and closing cover 200 as if the two components were a single rigid structure. The service technician opens opening and closing cover 200 until pivot plate 201 has rotated 90° relative to photocopier 100, after which, as shown in FIG. 8*b*, toner bottle 701 can be rotated in a forward direction out of photocopier 100.

As pivot plate 201 maintains a fixed position in relation to opening and closing cover 200 at this time, sufficient space is provided for the outward swing of toner bottle 701, space enough for the service technician to swing toner bottle 701 outward to an angle greater than 90° as shown in FIG. 8*b*. This mechanism thus prevents toner bottle 701 from coming into contact with the frame of photocopier 100 before sufficient space has been provided to allow full access to the internal area of the photocopier. Moreover, access to the image registration unit is not blocked by toner bottle 701 as the toner bottle is able to swing out to a rotational angle of more than 90°.

The mechanism by which opening and closing cover 200 and pivot plate 201 are able to swing open simultaneously allows the cover to open to an angle greater than the 90° angle to which it would be limited if structured as an independently hinged panel. As a result, toner bottle 701 is able to swing outward to an angle greater than 90° relative to photocopier 100, thus posing no hindrance to accessing image registration unit 702 which is located behind the toner bottle, and thus making maintenance work on the photocopier easier to perform.

This embodiment of photocopier 100 provides for L-bracket 406 as a structure through which opening and closing cover 200 can be pivotably connected to pivot plate 201. There are structures other than L-bracket 406, however, that can be applied to join opening and closing cover 200 to pivot plate 201. The following discussion will describe one of those other structures.

FIG. 9 illustrates a structure for photocopier 900 which does not use L-bracket 406. FIG. 9 provides a plan view (a) and a side view (b) of photocopier 900, both views showing the structure of photocopier 900 without L-bracket 406.

Figure 9A:
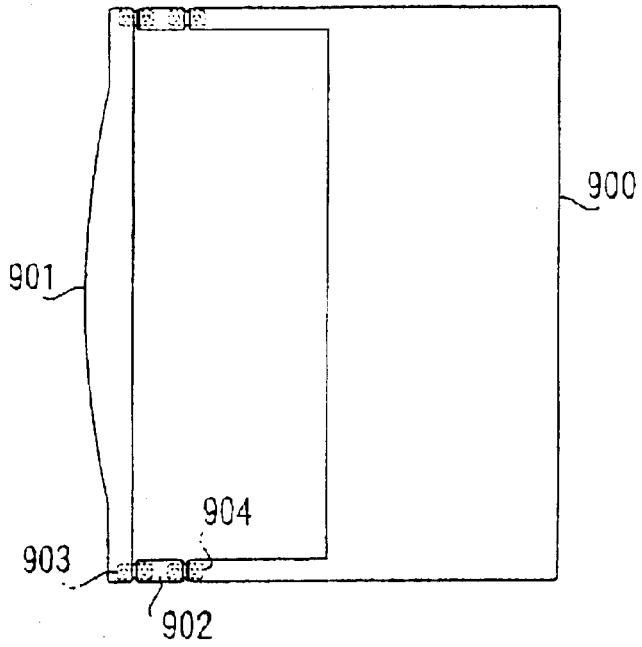
FIG. 9(*a*) is a top view of the photocopier wherein an L-bracket is not used and FIG. 9(*b*) is a side view of a photocopier wherein an L-bracket is not used, FIG. 10(*a*) is a top view of the photocopier wherein an L-bracket is not used and FIG. 10(*b*) is a side view of a photocopier wherein an L-bracket is not used, FIGS. 11(*a*) and 11(*b*) are top views of the photocopier wherein an L-bracket is not used, FIG. 12(*a*) is a frontal view of the photocopier wherein a differently shaped L-bracket is used, and FIG. 12(*b*) is a side view of the photocopier wherein a differently shaped L-bracket is used, FIGS. 13(*a*) and 13(*b*) are top views of the photocopier wherein a differently shaped L-bracket is used, FIGS. 14(*a*) and 14(*b*) are top views of the photocopier wherein a differently shaped L-bracket is used.

FIG. 9*a* shows one edge of opening and closing cover 901 pivotably connected to one edge of hinge plate 902 through hinge plate 903. The other edge of pivot plate 902 is pivotably connected to the frame of copier 900 through hinge plate 904.

Figure 9B:
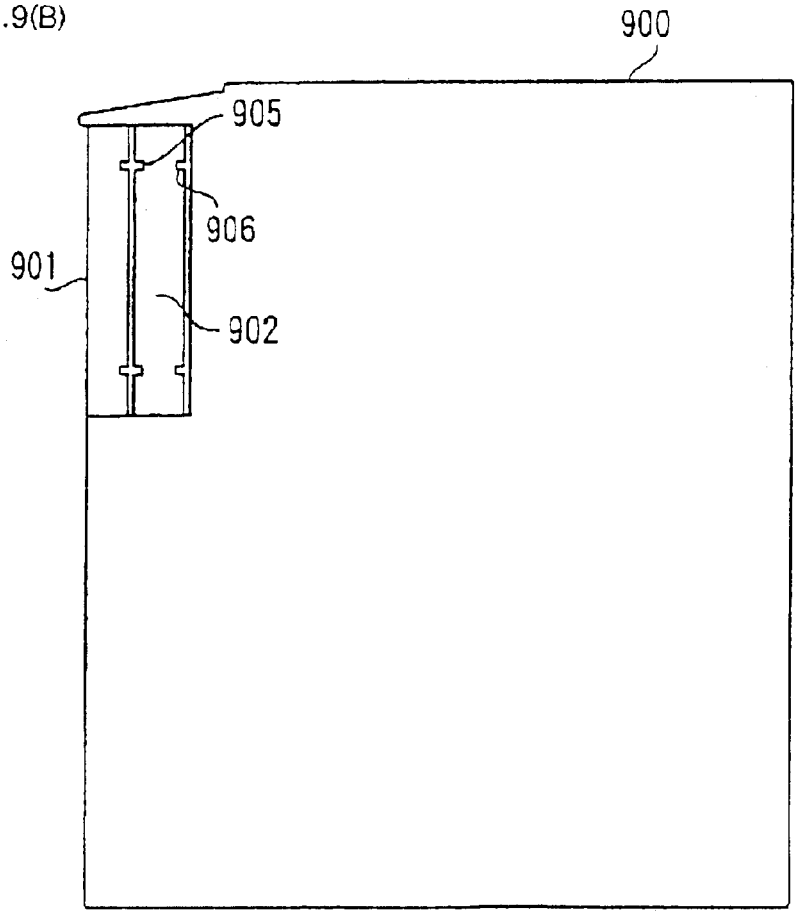

As shown in FIG. 9*b*, cutout portions 905 are formed within the rearward edge of opening and closing cover 901 and within the forward edge of pivot plate 902 as means of preventing pivoting hinge plate 903 from coming into contact with the opening and closing cover and pivot plate in a way that would prevent the opening and closing cover from opening. Cutout portions 906 are also formed within the rearward edge of pivot plate 902 as means of preventing pivoting hinge plate 903 from contacting pivot plate 902.

It is essential that the hinge structure described above provide sufficient space to allow an unencumbered pivoting movement between opening and closing cover 901 and pivot plate 902, and between pivot plate 902 and the frame of photocopier 900.

FIG. 9 illustrates a structure of photocopier 900 in which the aforesaid pivoting space is insufficient. In this case, opening and closing cover 901 is not able to freely pivot on pivot plate 902 as a result of their mutual interference, and pivot plate 902 is not able to pivot on the frame of photocopier 901 as a result of their mutual interference.

Figure 10A:
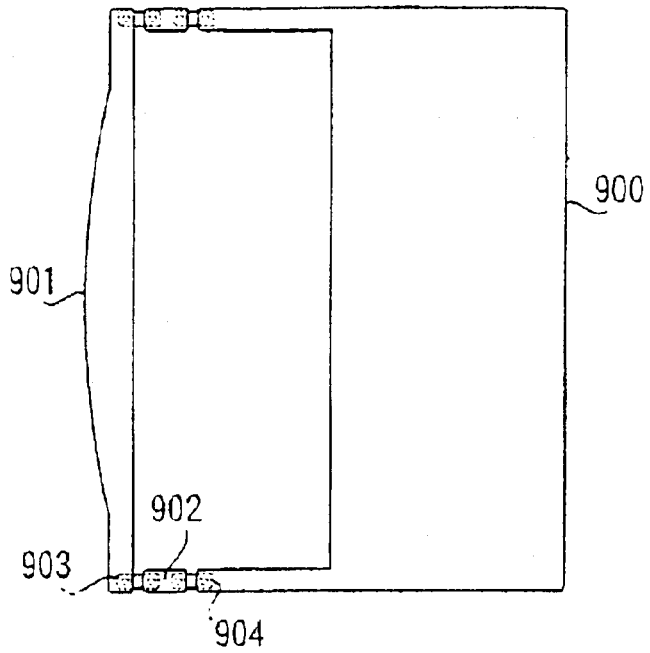

FIG. 10 illustrates a structure of photocopier 900 in which a sufficient amount of the aforesaid pivoting space has been provided to allow opening and closing cover 901 to freely pivot on pivot plate 902, and to allow pivot plate 902 to freely pivot on the frame of photocopier 900. Except for the additional pivoting space provided by the FIG. 10 structure, the structures for photocopier 900 shown in FIGS. 9 and 10 are identical.

The structure of photocopier 900 shown in FIG. 10 provides sufficient pivoting space between opening and closing cover 901 and pivot plate 902 to allow for their mutual opposing pivoting movement. As a result, there is no contact between opening and closing cover 901 and pivot plate 902, and between pivot plate 902 and the frame of photocopier 900.

Figure 11A:
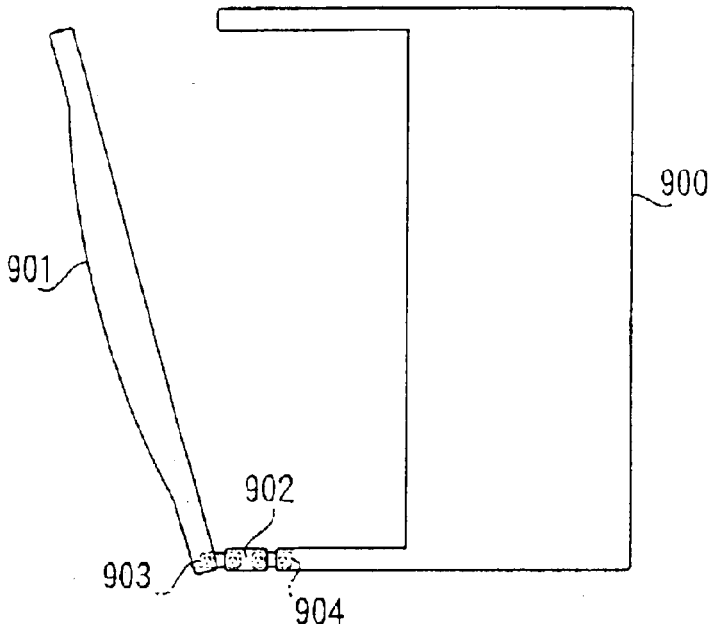
Figure 11B:
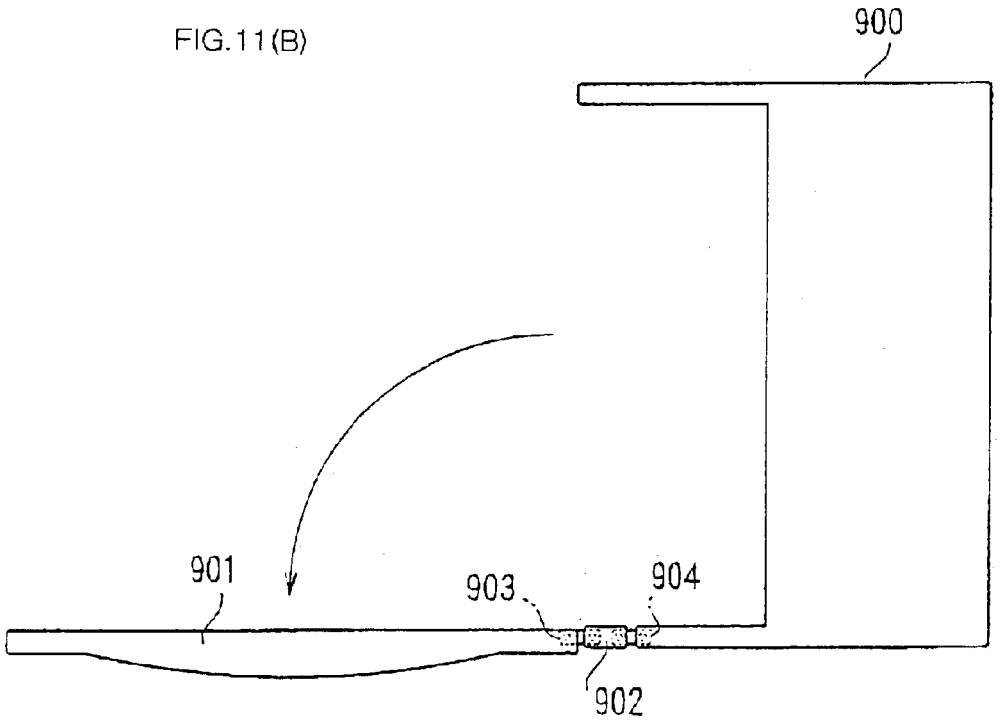

If opening and closing cover 901 is open as shown in FIGS. 11*a* and 11*b*, it is pivotably supported by the hinge mechanism connecting the cover and pivot plate 902, and pivot plate 902 is pivotably supported by the hinge mechanism connecting the pivot plate to the side of the photocopier.

As sufficient space must be provided for the mutual opposing pivoting movements of opening and closing cover 901 and pivot plate 902, however, gaps are formed between pivot opening and closing cover 901 and pivot plate 902, and between pivot plate 902 and photocopier 900. These gaps have the adverse effect of increasing the overall size of photocopier 900, and also allow the internal region of the photocopier to be seen through the gaps, thus resulting in an external panel structure that does not completely enclose the photocopier.

Figure 10B:
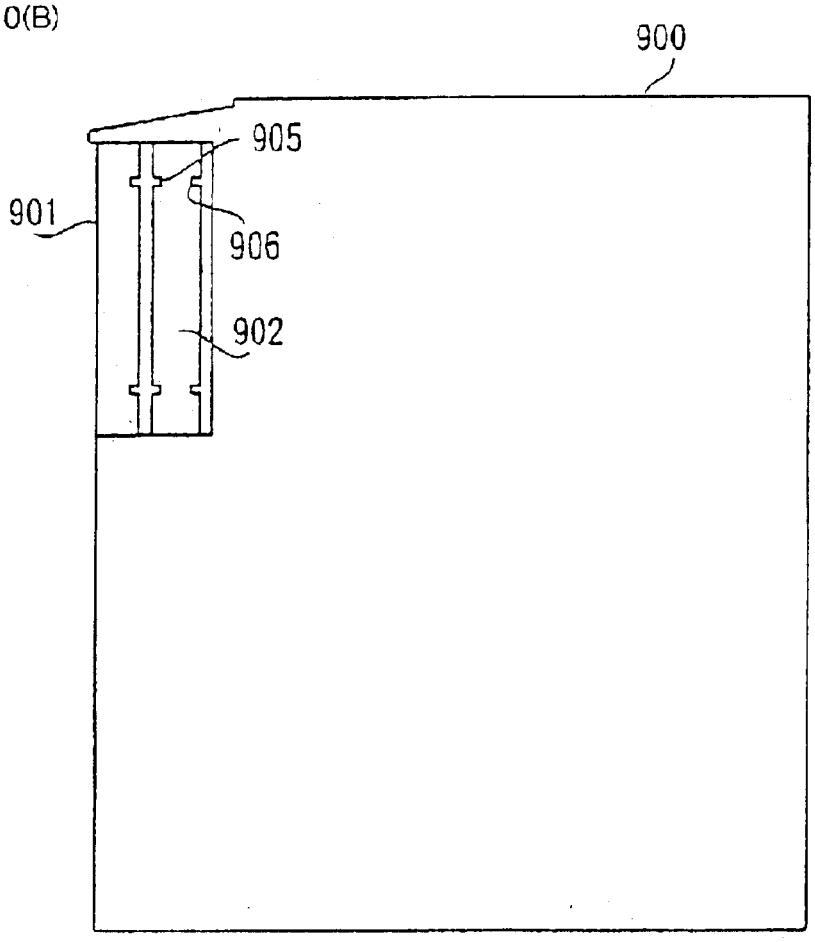

Another problem with the structure of photocopier 900 is that cutouts 905 must be provided within both edges of pivot plate 902 as shown in FIG. 10*b*. The use of these cutouts creates a problem in that they degrade the external appearance of the photocopier.

There is also a problem in that separate hinge mechanisms must be installed to both access cover 901 and pivot plate 902 in order to allow the access cover to open and close, thus requiring that a large number of hinge components be used.

Conversely, the photocopier 100 embodiment specifies L-bracket 406 that supports the free pivoting movement of opening and closing cover 200 on pivot plate 201, and hinge 405 that is installed only to one end of L-bracket 406. Even though opening and closing cover 200 and pivot plate 201 are in close mutual proximity, opening and closing cover 200 is able to open and close without interference with pivot plate 201 due to a pivoting action that is separated from hinge 405 a distance equal to the length of L-bracket 406. This structure thus allows for the free pivoting movement of opening and closing cover 200 without adding to the external dimensions of photocopier 100.

Moreover, opening and closing cover 200 is able to open widely relative to pivot plate 201 without the requirement that a large gap be provided between opening and closing cover 200 and pivot plate 201.

Furthermore, as illustrated in FIG. 2*b*, notches 202 need only be provided in the part of pivot plate 201 lying in the path of L-bracket 406. As a result, the external appearance of photocopier 200 is not degraded to the extent as that of photocopier 900 shown in FIGS. 9 and 10.

As the embodiment of the photocopier invention specifies that notches 202 be formed only in pivot plate 201, notches are not required in opening and closing cover 200, which also serves as one of the panels that defines the front surface of photocopier 100, thus resulting in a smooth non-broken surface on the front of the photocopier.

Moreover, by placing second hinge 405 on one edge of L-bracket 406, only a single hinged joint is required to allow opening and closing cover 200 to open and close, thus eliminating the need to use an additional hinged joint on opening and closing cover 901 as shown in FIGS. 9 and 10. As a result, photocopier 100 is able to use L-bracket 406 to form a freely pivoting joint between opening and closing cover 200 and pivot plate 201.

In the photocopier 100 embodiment, opening and closing cover 200 is attached to long side 406B of L-bracket 406, and pivot plate 201 is attached to short side 406A of L-bracket 406. In a case where opening and closing cover 200 and pivot plate 201 are joined through an L-bracket type of fixture, however, a structure can also be considered in which the long side of the L-bracket is connected to pivot plate 201, and the short side to opening and closing cover 200.

Figure 12B:
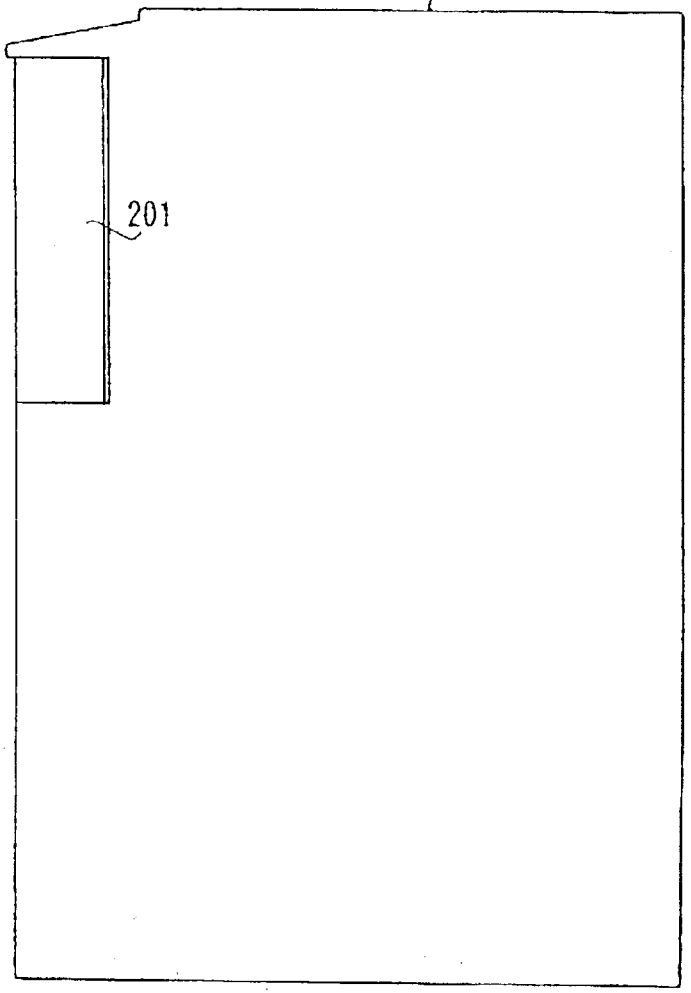
Figure 12A:
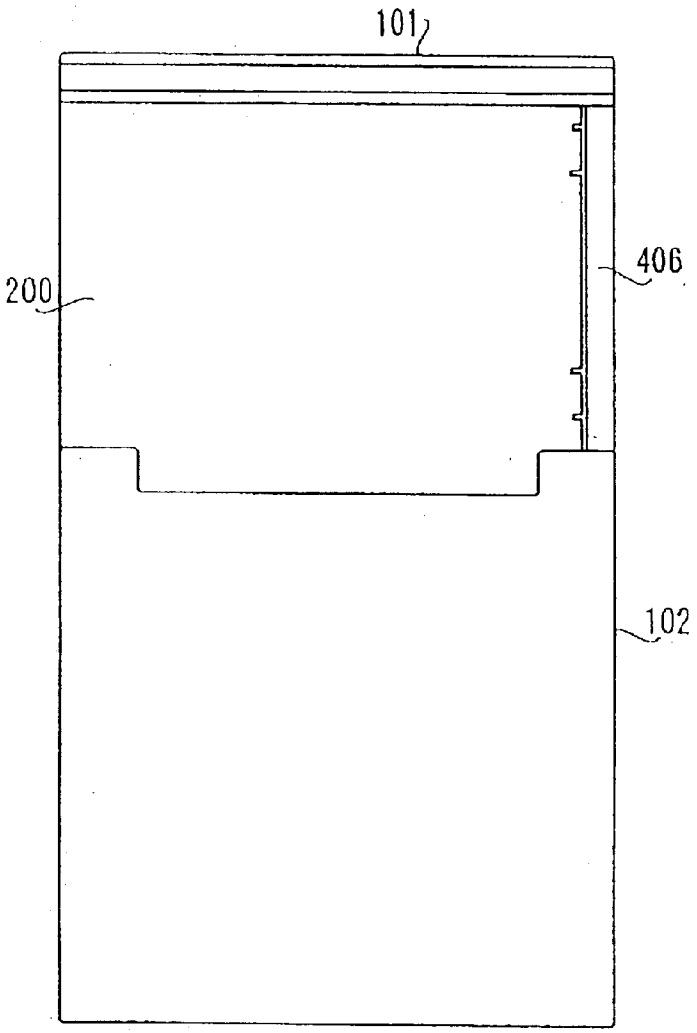

FIG. 12 illustrates the structure of photocopier 1200 in which pivot plate 201 is attached to the long side of the L-bracket, and opening and closing cover 200 to the short side of the L-bracket. FIG. 12*a* illustrates a front view of photocopier 1200 in which pivot plate 201 is fixedly attached to the long side of the L-bracket, and in which the short side is connected to access cover 200. FIG. 12*b* illustrates a side view of photocopier 1200 in which pivot plate 201 is fixedly attached to the long side of the L-bracket, and opening and closing cover 200 is connected to the short side.

In a case where opening and closing cover 200 is connected to pivot plate 201 in the above-described manner, the short side of L-bracket 406 is exposed at the front of photocopier 1200. Also, cutout sections must be provided in opening and closing cover 200 at the L-bracket connection points in order to prevent the L-bracket from contacting the opening and closing cover. Furthermore, as shown in FIG. 12*b*, pivot plate 201 is located on the side of photocopier 1200 at a location where the forward-facing edge of pivot plate 201 also forms the forward edge of the side of photocopier 1200.

The following discussion will describe the operation of opening and closing cover 200 of photocopier 1200. FIGS. 13 and 14 provide top views of photocopier 1200. Similar to the embodiment of the invention, spring 408 is incorporated into the hinge installed to the short side of L-bracket 406.

Figure 13A:
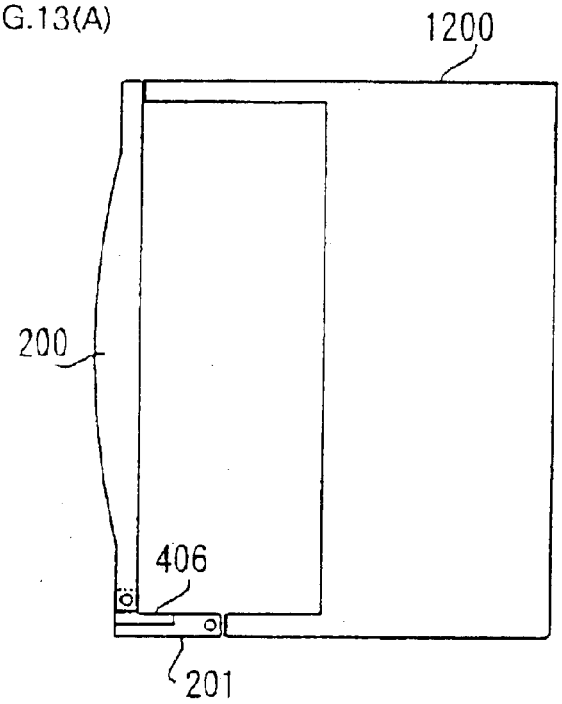
Figure 13B:
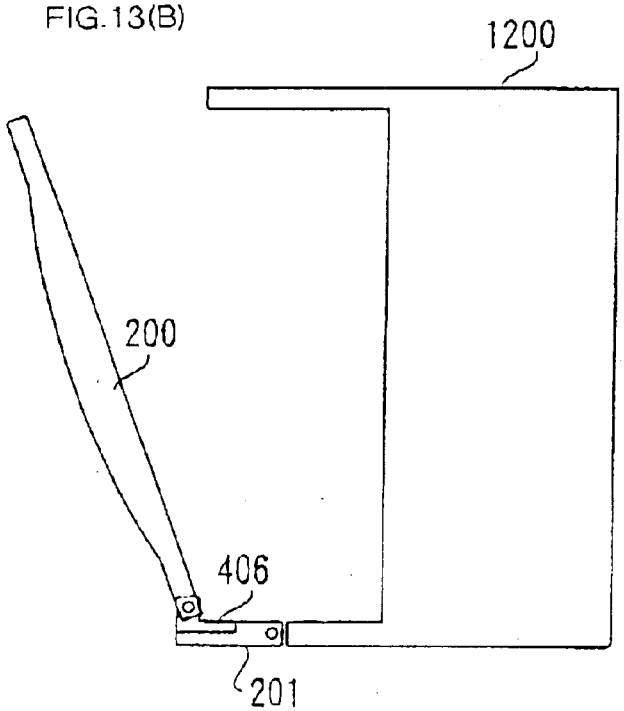

FIG. 13*a* illustrates opening and closing cover 200 closed against photocopier 1200. When opening and closing cover 200 is opened from this closed position, the opening and closing cover swings open in the forward direction pivotably supported by the hinge attached to the end of the short side of L-bracket 406 as shown in FIG. 13*b*. As opening and closing cover 200 is not yet in a fully opened position, pivot plate 201 does not open.

Figure 14A:
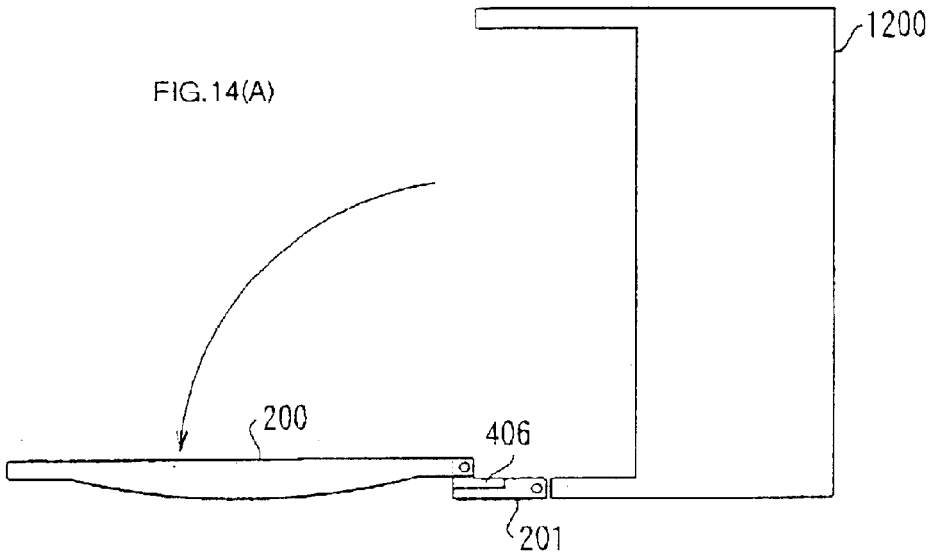

Opening and closing cover 200 continues to swing open from the position shown in FIG. 13*b* to that shown in FIG. 14*a* where the opening and closing cover has pivoted approximately 90° relative to pivot plate 201. This is the angle at which opening and closing cover 200 has completely opened, and at which the pressure applied by spring 408 maintains pivot plate 201 in a fixed position relative to opening and closing cover 200 so as to allow the opening and closing cover and pivot plate to rotate together as a single rigid structure.

Figure 14B:
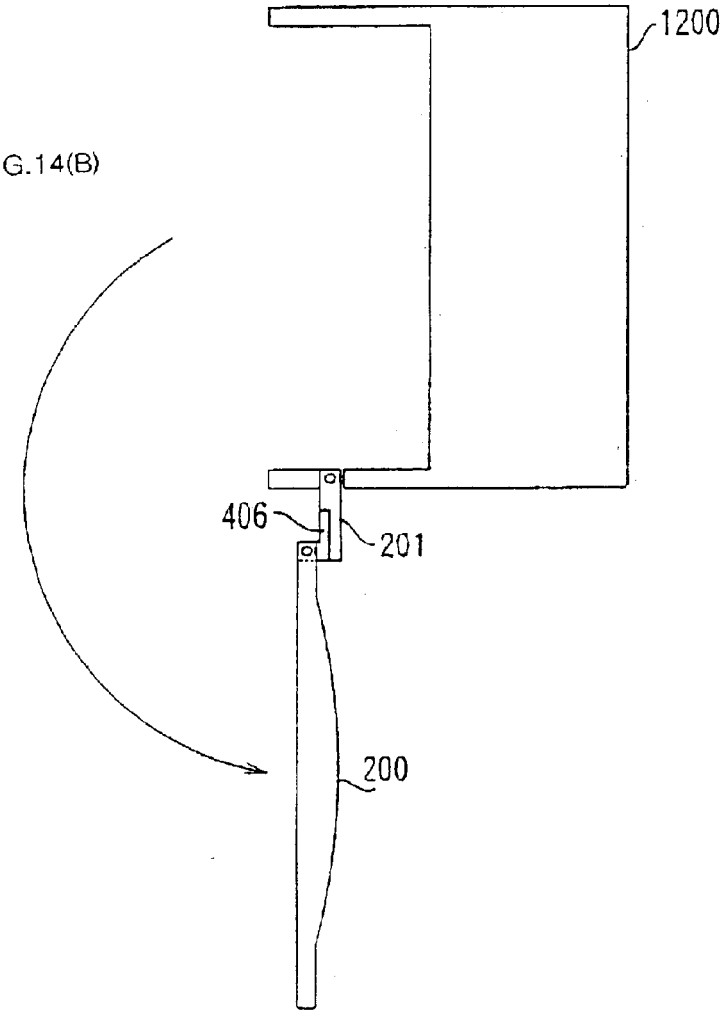
Figure 15:
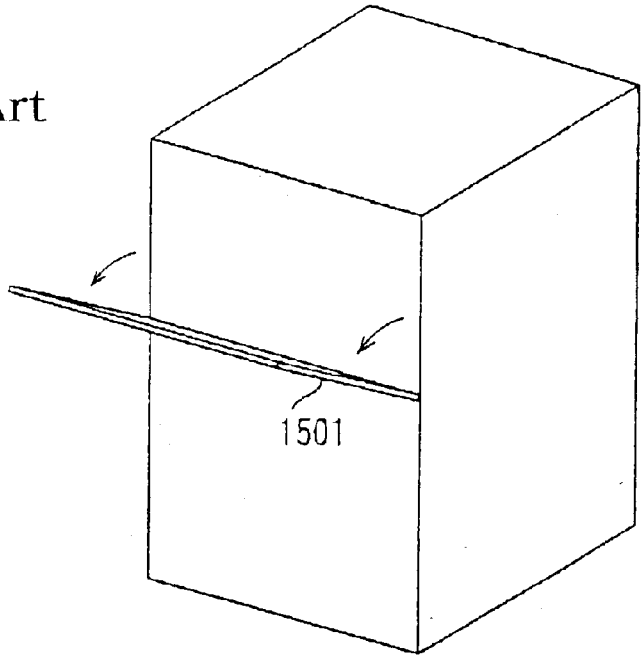
FIG.15 Prior Art
FIG. 15 is a front perspective view of a conventional photocopier.
Figure 16:
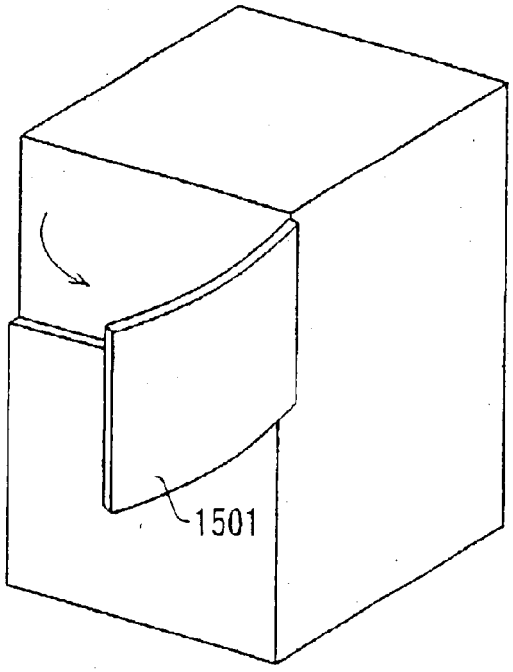
FIG.16 Prior Art
FIG. 16 is a front perspective view of a conventional photocopier.
Figure 17:
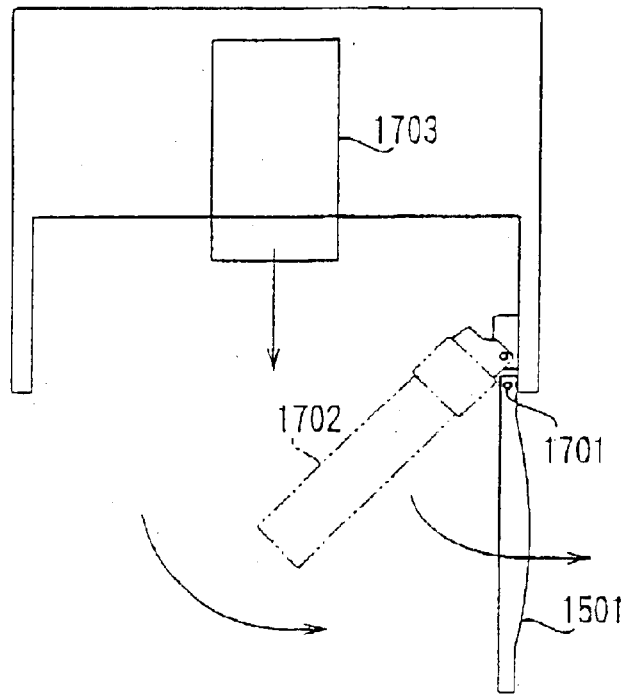
FIG. 17 Prior Art
FIG. 17 is a top view of a conventional photocopier.
Figure 18:
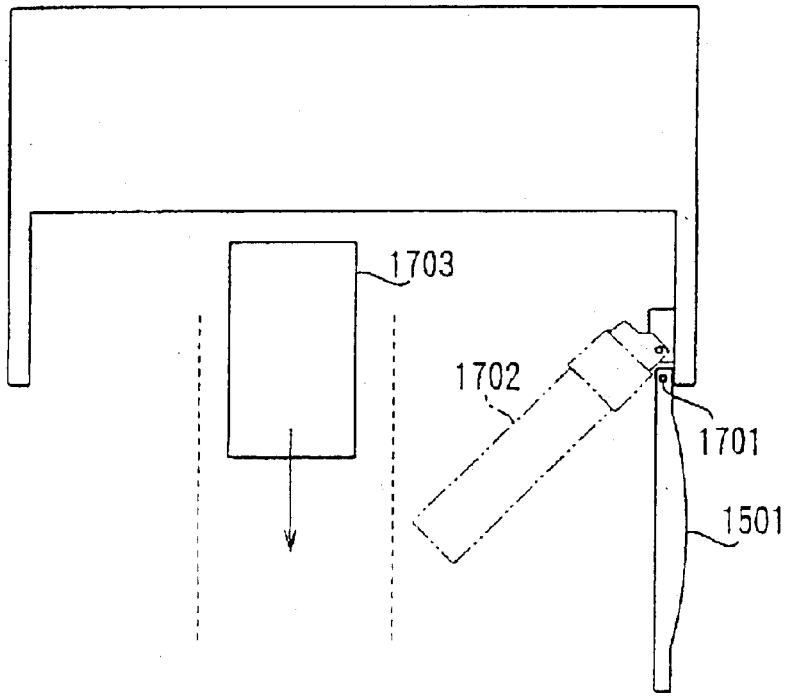
FIG. 18 Prior Art
FIG. 18 is a top view of a conventional photocopier.
Figure 19:
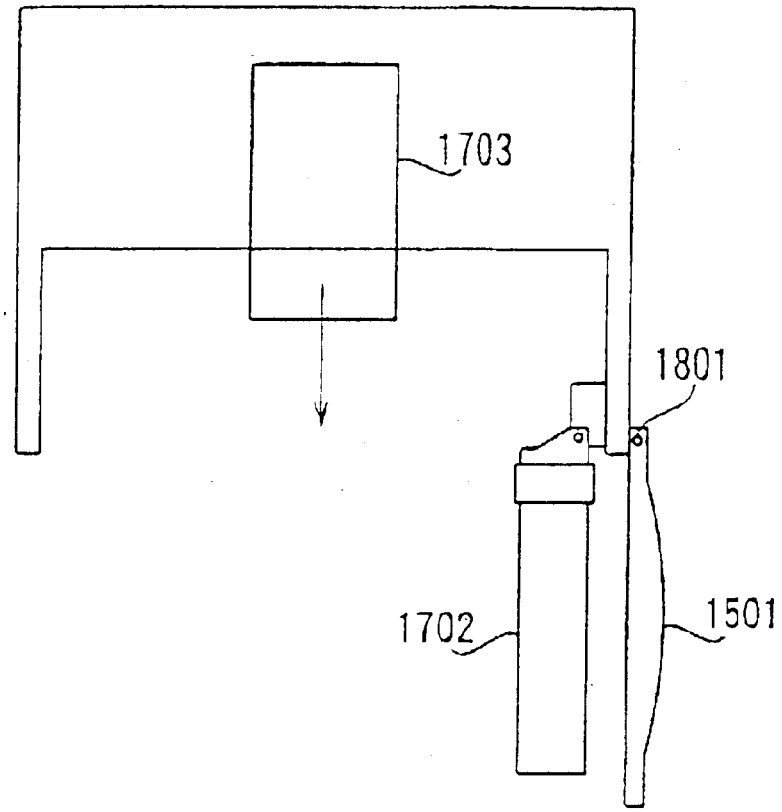
FIG. 19 is a top view of a conventional photocopier.

As a result of this mechanism, pivot plate 201 swings open from the side of photocopier 1200 as opening and closing cover 200 continues to pivot open from the position shown in FIG. 14*a* to that shown in FIG. 14*b*. The pivoting action of pivot plate 201 is supported by the hinge installed to the frame side of photocopier 1200.

Even though opening and closing cover 200 itself has opened to its maximum angle as shown in FIG. 14*a*, it is still located on the photocopier side of pivot plate 201. As a result, photocopier components located near the inner side of pivot plate 201 will come into contact with pivot plate 201 when an attempt is made to pull those components out of the photocopier.

In the photocopier 100 embodiment shown in FIG. 6*a*, however, opening and closing cover 200, when opened to its maximum angle, is located on the side of pivot plate 201 facing away from the photocopier. As a result, components can be located within the photocopier directly behind pivot plate 201 and remain accessible. This structure substantially reduces unusable space inside the photocopier to a minimum, and allows the photocopier to be made to more compact external dimensions. For this reason, photocopier 100 employs a structure in which opening and closing cover 200 is attached to long side 406B of L-bracket 406, and pivot plate 201 to short side 406A of L-bracket 406.

While the invention has been described in the form of the embodied photocopier 100 equipped with pivot plate 201, the invention may also be applied to any type of apparatus equipped with an opening and closing cover 200 as means of accessing the inner region of the apparatus for maintenance or other purposes. The invention is particularly applicable, for example, to a multifunctional printing apparatus that includes any combination of computer printing, copying, and facsimile printing functions.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

This application is based on the Japanese Patent Application No. 2002-060947 filed on Mar. 6, 2002, entire content of which is expressly incorporated by reference herein.

What is claimed is:

1. A photocopier comprising:

an intermediate member pivotably attached to the photocopier at one edge of said intermediate member; and an opening and closing cover pivotably attached to said intermediate member at an opposite edge of said intermediate member;

wherein:

when said open and closing cover is opened, an image recording system located within the photocopier is exposed; and when said opening and closing over is closed against the photocopier, said opening and closing cover becomes a front surface of the photocopier and said intermediate member becomes a side surface of the photocopier.

2. The photocopier according to claim 1, wherein said opening and closing cover opens to an approximate 90-degree angle in relation to said intermediate member, and said intermediate member pivots to an approximate 90-degree angle in relation to the photocopier.

3. The photocopier according to claim 1, wherein said intermediate member is forced so as to remain in a closed position when said opening and closing cover has not pivoted to a fully opened position.

4. The photocopier according to claim 1, wherein said intermediate member is forced so as to be maintained in a closed position when said opening and closing cover is not completely open, and said opening and closing cover and intermediate member are maintained in mutually fixed positions when said opening and closing cover pivots to a fully open position.

5. The photocopier according to claim 1, wherein said opening and closing cover is provided to said intermediate member by an L-shaped bracket, through a hinge installed to a leading edge of the L-shaped bracket.

6. The photocopier according to claim 5, wherein the L-shaped bracket is installed to said opening and closing cover, and a short side of the L-shaped bracket is connected to the intermediate member through a freely pivoting joint.

7. A photocopier comprising:

an intermediate member pivotably attached to the photocopier at one edge of said intermediate member; and an opening and closing cover pivotably attached to said intermediate member at an opposite edge of said intermediate member;

wherein when said opening and closing over is closed against the photocopier, said opening and closing cover becomes a front surface of the photocopier and said intermediate member becomes a side surface of the photocopier.

8. The photocopier according to claim 7, further comprising:

a toner receptacle positioned inside the copier at an outermost part of an internal area of the photocopier; and a recording section removably provided inside the photocopier at a position behind said toner receptable;

wherein when said opening and closing cover is opened, said toner is configured to pivot an angle greater than 90-degrees.

9. A photocopier comprising:

an intermediate member pivotably attached to the photocopier at one edge of said intermediate member; and an opening and closing cover pivotably attached to said intermediate member at an opposite edge of said intermediate member;

wherein said intermediate member is configured to remain in a closed position until said opening and closing cover has pivoted to a fully opened position.

10. A photocopier comprising:

an intermediate member pivotably attached to the photocopier at one edge of said intermediate member; and an opening and closing cover pivotably attached to said intermediate member at an opposite edge of said intermediate member;

wherein:

said intermediate member is configured to be maintained in a closed position when said opening and closing cover is not completely open; and said opening and closing cover and intermediate member are maintained in mutually fixed positions so as to pivot together as a single unit when said opening and closing cover pivots to a fully open position.

11. A multifunctional printer comprising:

an intermediate member pivotably attached to the photocopier at one edge of said intermediate member; and an opening and closing cover pivotably attached to said intermediate member at an opposite edge of said intermediate member;

wherein when said opening and closing over is closed against the photocopier, said opening and closing cover becomes a front surface of the photocopier and said intermediate member becomes a side surface of the photocopier.

12. The photocopier according to claim 11, further comprising:

a toner receptacle positioned inside the copier at an outermost part of an internal area of the photocopier; and a recording section removably provided inside the photocopier at a position behind said toner receptacle;

wherein when said opening and closing cover is opened, said toner receptable is configured to pivot an angle greater than 90-degrees.

* * * * *

UNITED STATES PATENT AND TRADEMARK OFFICE

CERTIFICATE OF CORRECTION

PATENT NO. : 6,782,223 B2
DATED : August 24, 2004
INVENTOR(S) : Y. Yoshida

It is certified that error appears in the above-identified patent and that said Letters Patent is hereby corrected as shown below:

Column 13,
Lines 5 and 40, “over” should be -- cover --.

Column 14,
Line 35, “over” should be -- cover --.

Signed and Sealed this

Tenth Day of May, 2005

JON W. DUDAS
*Director of the United States Patent and Trademark Office*